US012065907B2

(12) United States Patent
Baker et al.

(10) Patent No.: US 12,065,907 B2
(45) Date of Patent: Aug. 20, 2024

(54) DRILL ASSEMBLY FOR PERCUSSIVE DRILLING

(71) Applicant: ROBIT PLC, Lempäälä (FI)

(72) Inventors: Adam Baker, Wickenby (GB); Joonas Sokka, Tampere (FI)

(73) Assignee: ROBIT PLC, Lempäälä (FI)

( * ) Notice: Subject to any disclaimer, the term of this patent is extended or adjusted under 35 U.S.C. 154(b) by 0 days.

(21) Appl. No.: 18/003,940

(22) PCT Filed: Jul. 1, 2021

(86) PCT No.: PCT/FI2021/050508
§ 371 (c)(1),
(2) Date: Dec. 30, 2022

(87) PCT Pub. No.: WO2022/003253
PCT Pub. Date: Jan. 6, 2022

(65) Prior Publication Data

US 2023/0258043 A1 Aug. 17, 2023

(30) Foreign Application Priority Data

Jul. 3, 2020 (FI) ..... 20205718

(51) Int. Cl.
*E21B 4/14* (2006.01)
*E21B 6/00* (2006.01)
*E21B 10/36* (2006.01)

(52) U.S. Cl.
CPC ..... *E21B 4/14* (2013.01); *E21B 6/00* (2013.01); *E21B 10/36* (2013.01)

(58) Field of Classification Search
CPC ... E21B 6/00; E21B 10/36; E21B 4/14; B21K 25/00
See application file for complete search history.

(56) References Cited

U.S. PATENT DOCUMENTS

2009/0308661 A1 12/2009 Wolfer et al.
2011/0232922 A1* 9/2011 Yao ..... E21B 6/00 166/386

(Continued)

FOREIGN PATENT DOCUMENTS

AU 2011202932 A1 5/2012
EP 2873799 A1 5/2015

(Continued)

OTHER PUBLICATIONS

Finnish Office Action issue din corresponding Patent Application No. 20205718 dated Jan. 27, 2021.

(Continued)

*Primary Examiner* — Yong-Suk (Philip) Ro
(74) *Attorney, Agent, or Firm* — Buchanan Ingersoll & Rooney PC

(57) ABSTRACT

A drill assembly for percussive drilling, comprising a drill bit and a percussion device. The drill assembly further includes a hollow cylindrical foot valve partially received within a first central flushing channel thereof and extending therefrom in the uphole direction, such that the foot valve is also partially received within a central recess of an impact piston of the percussion device, at least when the impact piston is in a lowermost position of its reciprocation cycle, and such that the foot valve is no longer received within the central recess, at least when the impact piston is in an uppermost position of its reciprocation cycle. The foot valve includes an internal stiffener extending radially inwardly from at least two circumferential positions of an inner surface of the foot valve.

16 Claims, 7 Drawing Sheets

(56) References Cited

U.S. PATENT DOCUMENTS

| | | | |
|---|---|---|---|
| 2013/0327576 | A1 | 12/2013 | Gien |
| 2016/0298390 | A1 | 10/2016 | Kraft et al. |

FOREIGN PATENT DOCUMENTS

| | | | |
|---|---|---|---|
| SE | 1251013 | A1 | 9/2012 |
| WO | 2006116646 | A2 | 11/2006 |

OTHER PUBLICATIONS

Finnish Search Report issued in corresponding Patent Application No. 20205718 dated Jan. 27, 2021.
International Preliminary Report on Patentability (PCT/IPEA/409) issued on Aug. 5, 2022, by the European Patent Office as the International Search Authority for International Application No. PCT/FI2021/050508.
International Search Report (PCT/ISA/210) and Written Opinion (PCT/ISA/237) mailed on Oct. 19, 2021, by the Finnish Patent Office as the International Searching Authority for International Application No. PCT/FI2021/050508.

* cited by examiner

DRILL ASSEMBLY FOR PERCUSSIVE DRILLING

FIELD OF THE DISCLOSURE

The present disclosure relates to percussive drilling, and more particularly to a drill assembly for DTH (down-the-hole) drilling. The present disclosure further concerns a foot valve used in such a drill assembly.

BACKGROUND OF THE DISCLOSURE

In percussive drilling, percussive impacts transmitted by the drill bit are used to break the ground at the bottom of the borehole. In so-called DTH (down-the-hole) applications, the impact device is arranged within the borehole in connection with the drill bit, and is powered by a pressurized fluid. Typically, this pressurized fluid is also used to flush cuttings from the bottom of the borehole.

In conventional arrangements the pressurized fluid is selectively conducted between an uphole facing surface of the percussion device, driving an impact piston towards a downhole direction a foot valve, and a downhole facing surface, thereby driving the piston towards an uphole direction. In an intermediate period in between driving the impact piston in a downhole direction and driving the piston in a uphole direction, the pressurized fluid is conducted to a central flushing channel of an associated drill bit, so as to be further conducted to the bottom of the borehole for flushing cuttings therefrom.

In order to ensure sufficient pressure build-up required to drive the impact piston in the uphole direction, the opening of the drill bit's central flushing channel has conventionally been equipped with a foot valve extending in an uphole direction therefrom, through which foot valve the pressurized fluid is conducted to central flushing channel for the drill bit. To prevent pressurized fluid from flowing to the central flushing channel after the impact piston has reached its lowermost position (i.e., when pressurized fluid is required to drive the impact piston towards the uphole direction), the foot valve has been configured to be received within a cavity of the impact piston, thereby blocking flow to the central flushing channel.

It has been considered a general desire to improve the durability of the foot valve, as failure thereof results in the percussion device becoming inoperable interrupting the drilling operation to a standstill until the foot valve is replaced. Furthermore, replacing the foot valve requires removing the whole drill string from the borehole in addition to disassembling the percussion device, which is very time consuming. As a result, the financial costs associated with a foot valve failure increase as the borehole becomes deeper.

Typical failure mechanisms of the foot valve are thought to include dislodging of the foot valve caused by a worn or loose interference fit, cracking of the foot valve caused by impacts from drilling debris, water between an impact surface of the drill bit and the impact piston shooting against the foot valve, the drill bit's impact surface peening over towards the foot valve, and damaged piston bore or impact surface.

Moreover, the general trend towards increased drilling pressure (the pressure at which the impact device is operated) would appear to increase the risk of foot valve failure.

In order to overcome some of the shortcoming, DTH percussion devices without foot valves have been developed However, such attempts arrangements have generally resulted in excessively complicated structures and the efficiency of such valveless percussion devices have not achieved the efficiency of the devices with foot valve.

BRIEF DESCRIPTION OF THE DISCLOSURE

An object of the present disclosure is to provide a drill assembly for percussive drilling, in which the durability of the foot valve is improved.

The object of the disclosure is achieved by the drill assembly which is characterized by what is stated in the independent claim. The preferred embodiments of the disclosure are disclosed in the dependent claims.

The disclosure is based on the idea of providing the foot valve with an internal stiffener thereby improving the capability of the foot valve to withstand the strain exerted thereon.

An advantage of the disclosure is that more reliable operation of the impact device is achieved.

According to the disclosure, a drill assembly for percussive drilling is provided. The drill assembly comprises a drill bit, a percussion device and a foot valve.

The drill bit extends along a longitudinal direction of the drill assembly, and comprises a distal portion having an end surface equipped with inserts for transferring percussive impact to points of contact with a borehole. The distal portion of the drill bit is at a downhole end of the drill assembly, i.e. at the bottom of the borehole, when in use.

The drill bit further comprises a shank portion extending from the distal portion in an uphole direction. The shank portion is equipped with a male coupling configuration and, on a longitudinal uphole end of the shank portion, a first impact surface. Preferably, but not necessarily, the male coupling configuration may be provided as a male splined surface extending longitudinally along the shank portion.

The drill bit further comprises a first central flushing channel for conducting a flushing fluid flow to the end surface of the distal portion. The first central flushing channel extends through at least the shank portion and is open towards the longitudinal uphole end of the shank portion, such that the first impact surface is formed annularly around the central flushing channel.

The percussion device extends along a longitudinal direction and comprises, on downhole side end thereof, a female coupling configuration for coupling with the male coupling configuration of the drill bit. Preferably, but not necessarily, the female coupling configuration may be provided as a female splined surface arranged to cooperate with a male splined surface of the drill bit.

The percussion device further comprises an impact piston arranged within a housing and configured to reciprocate in the longitudinal direction when a flushing fluid flow is conducted through the percussion device. The impact piston has a central recess, and a second impact surface annularly surrounding the central recess for impacting against the first impact surface of the drill bit when the impact piston is reciprocated. For example, the central recess of the impact piston may be provided as a second central flushing channel for conducting a flushing fluid flow through the impact piston The drill assembly further comprises a hollow cylindrical foot valve attached to the drill bit. The foot valve is partially received within the first central flushing channel and extends therefrom in the uphole direction.

The foot valve 9 is also partially received within the central recess, at least when the impact piston is in a lowermost position of its reciprocation cycle, i.e., when the impact piston abuts the drill bit. On the other hand, the foot valve is no longer received within the central recess, at least when the impact piston is in an uppermost position of its reciprocation cycle. Preferably, but not necessarily, the foot valve is withdrawn from and inserted to the central recess at a position of the impact piston between the uppermost and lowermost positions of its reciprocation cycle.

Particularly, the foot valve comprises an internal stiffener extending radially inwardly from at least two circumferential positions of an inner surface of the foot valve. Preferably, but not necessarily, the internal stiffener may extend between at least two circumferential positions of an inner surface of the foot valve.

In an embodiment according to the present disclosure, the internal stiffener extends along the longitudinal length of the foot valve.

It should be noted, however, that the internal stiffener does not need to extend for the whole length of the foot valve.

In an embodiment according to the present disclosure, the internal stiffener is formed as one or more internal walls of the foot valve.

Preferably, but not necessarily, the internal stiffener is formed as a plurality of internal walls of the foot valve such that at least two of the internal walls coincide with each other, as seen along the cross-sectional profile of the foot valve perpendicular to the longitudinal direction thereof.

Preferably, but not necessarily, the internal stiffener is formed as a plurality of internal walls of the foot valve such that at least two of the internal walls intersect with each other, as seen along the cross-sectional profile of the foot valve perpendicular to the longitudinal direction thereof.

In an embodiment according to the present disclosure, the internal stiffener is formed as an integral part of the foot valve. This may be achieved, for example, by forming the foot valve by moulding, such as injection moulding. Alternatively, the foot valve may be machined from a suitable solid piece or profile piece, or it could be constructed as an assembly of separate parts.

Suitable materials for the foot valve include, for example, polymers such as polyoxymethylene (POM or fibre reinforced plastics (FRP). Alternatively, if the foot valve is constructed as an assembly of separate parts, a combination of polymer and metal materials may be used.

In an embodiment according to the present disclosure, the internal stiffener extends longitudinally for a first distance from an uphole side end of the foot valve, the first distance being less than or equal to a distance for which the foot valve projects from the drill bit.

In this kind of an arrangement, the stiffener helps the foot valve maintain its form against forces caused by the impact piston, while insertion of the foot valve into the first flushing channel is facilitated, as the foot valve may more easily deform at a portion thereof at which the stiffener is not exhibited.

It should be noted, however, that the stiffener 10 does not need to extend from the uphole side end of the foot valve, but may be longitudinally distanced therefrom.

In an embodiment according to the present disclosure, the internal stiffener extends longitudinally for a first distance from an uphole side end of the foot valve, the first distance being more than or equal to a distance for which the foot valve projects from the drill bit.

In this kind of an arrangement, the stiffener helps the foot valve maintain its form against forces caused by the impact piston, while secure attachment of the foot valve within the first flushing channel is facilitated, as the foot valve may exhibits increased rigidity also within the flushing channel.

It should be noted, however, that the stiffener 10 does not need to extend from the uphole side end of the foot valve, but may be longitudinally distanced therefrom.

In an embodiment according to the present disclosure, a cut-out extending radially through foot valve is provided extending axially for a second distance from a downhole side end of the foot valve, wherein the second distance being less than or equal to a length at which the foot valve is received within the drill bit.

That is, a cut-out extending laterally through the outer wall of foot valve may be provided on the foot valve at a portion thereof received within the drill bit.

Such an arrangement facilitates insertion of the foot into the first flushing channel as it enables the respective portion of the foot valve to yield more easily, thereby conforming into the shape of the first flushing channel Preferably, but not necessarily, a projection of the cut-out on a plane parallel with the longitudinal direction is a differentiable curvature opening towards a downhole side end of the foot valve. In other words, the outline of the cut-out is smooth and continuous, thereby eliminating excessive peaks of internal stresses caused by a discontinuous geometry.

In an embodiment according to the present disclosure, the foot valve is provided with a section of increased outer diameter at a portion of the foot valve received within the drill bit. This may be carried out to ensure sufficient friction between the outer wall of the foot valve and the inner wall of the first flushing channel caused to maintain the foot valve in place during operation.

It should be noted that the present disclosure encompasses any combination of two or more embodiments, or variants thereof, as discussed above.

BRIEF DESCRIPTION OF THE DRAWINGS

In the following the disclosure will be described in greater detail by means of preferred embodiments with reference to the accompanying drawings, in which.

DETAILED DESCRIPTION OF THE DISCLOSURE

Figure 1:
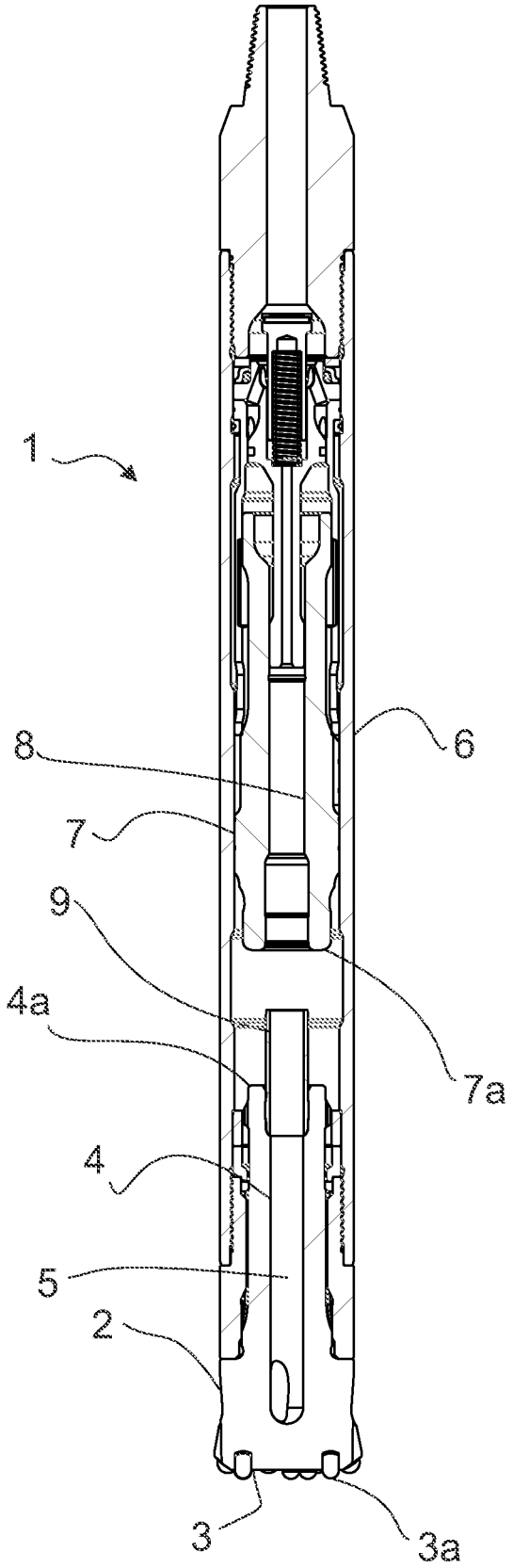
FIG. 1 and FIG. 2 illustrate longitudinal cut view of a drill assembly according to the present disclosure.

FIG. 1 illustrates a longitudinal cut view of a drill assembly 1 according to the present disclosure. The drill assembly 1 comprises a drill bit 2 having a distal portion (3) at the downhole end side of the drill bit. The distal portion 3 is equipped, at an end surface thereof, with inserts 3*a* for cutting and/or crushing the ground at the bottom of the borehole. A shank portion 4 extends from the distal portion towards an uphole direction, and has a first impact surface 4*a* on a longitudinal uphole end thereof. A first central flushing channel 5 extends at least through the shank portion 4 so as to conduct a flushing fluid flow to the end surface of the distal portion 3. Particularly the first impact surface 4*a* is formed annularly around the first central flushing channel 5.

The drill assembly further comprises a percussion device 6, generally known as a DTH-hammer. The percussion device is coupled to the shank portion of the drill bit with mutual engaging surfaces, such as a male and female splined surfaces on the shank portion and on the downhole side end of the percussion device, respectively.

Particularly, the percussion device 6 has an impact piston arranged within a housing, which is configured to reciprocate in the longitudinal direction, when a flushing fluid flow is conducted through the percussion device. The impact piston 7 has a central recess 8 provided as a second central flushing channel for conducting a flushing fluid flow through the impact piston 7. A second impact surface 7*a* of the impact piston annularly surrounds the second central flushing channel 8.

FIG. 1 also illustrates a hollow cylindrical foot valve 9 attached to the drill bit 2 and partially received within the first central flushing channel 5 and extending therefrom in the uphole direction.

Particularly, FIG. 1 illustrates the drill assembly in situation in which the impact piston 7 is in an uppermost positions of its reciprocation cycle, wherein the second impact surface 7*a* is distanced from the first impact surface 4*a* and the foot valve 9 is not received within the second central flushing channel 8

Figure 2:
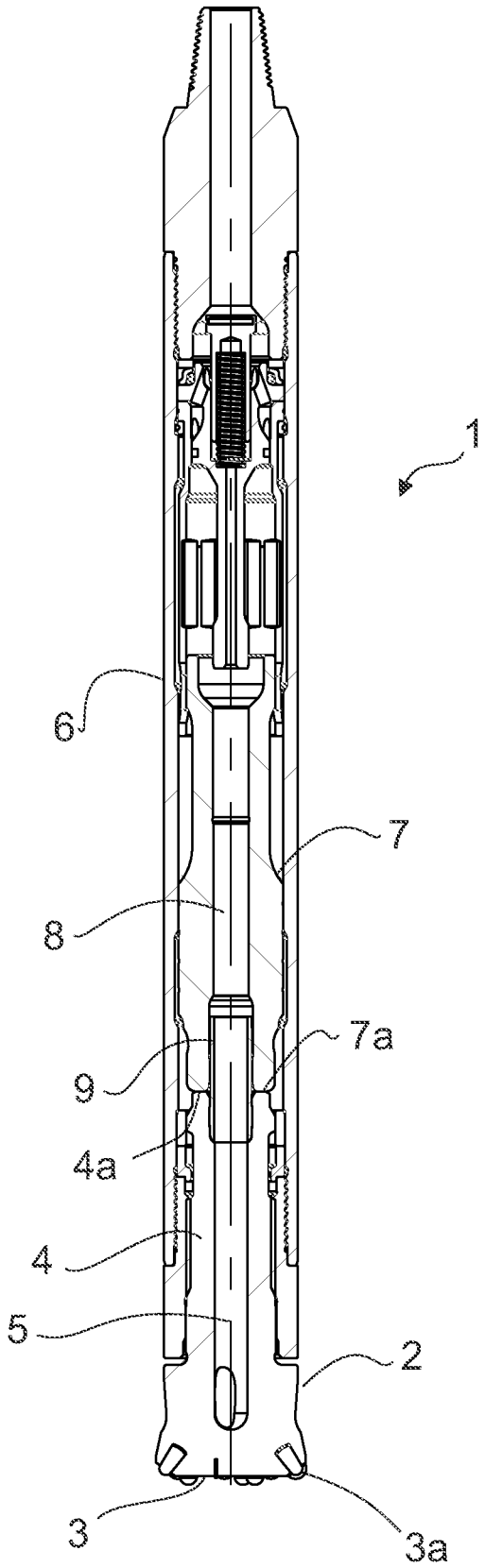

FIG. 2, in turn, illustrates the drill assembly of FIG. 1 when the impact piston is in a lowermost position of its reciprocation cycle, wherein the first and second impact surfaces 4*a*, 7*a* abut each other, and the foot valve 9 partially received also within the second central flushing channel.

Figure 3A:
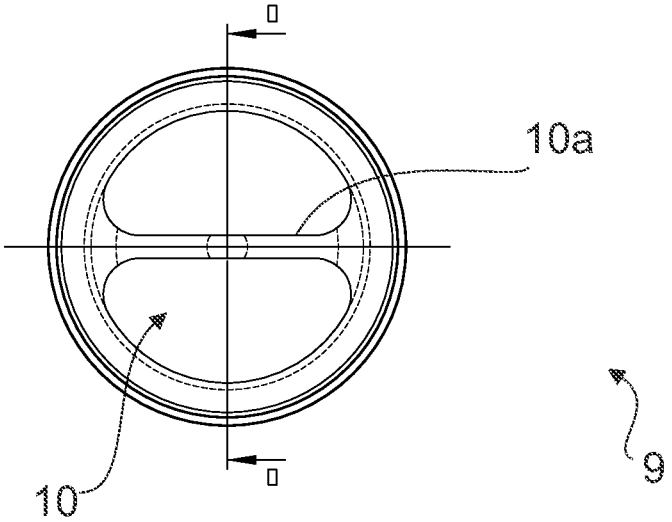
FIG. 3*a*-FIG. 8*c* illustrate various embodiments of a foot valve according to the present disclosure.
Figure 3B:
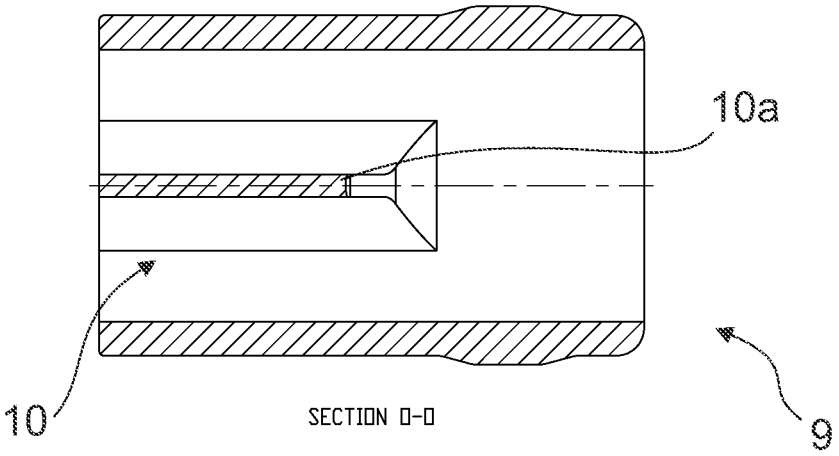
Figure 3C:
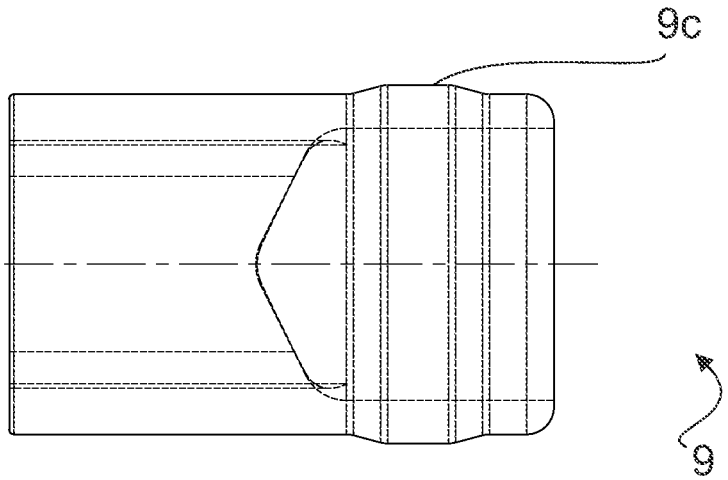

FIG. 3*a*-FIG. 3*c* illustrate an embodiment of the foot valve 9 according to the present disclosure as seen as plan vie, longitudinally cut view and a side view, respectively. Particularly, the stiffener 10 has been provided as a single linear internal wall 10*a* extending between opposing point of internal surface of the foot valve 9, through a cross-sectional centre point thereof.

As best illustrated in FIG. 3*a*, the material thickness of the internal wall 10*a* is increased where the internal wall 10*a* adjoins the internal surface of the foot valve 9. Moreover, the internal wall 10*a* extends for distance from the uphole side ned of the foot valve 9 such that it does not extend up to the opposing downhole side end of the foot valve 9. Additionally, the foot valve 9 is provided with a section of increased outer diameter 9*b* at a distance from the downhole side end of the foot valve 9. Notably, the section of increased outer diameter 9*b* is provided at a portion of the foot valve 9 where the stiffener 10 is not exhibited. In use, the section of increased diameter 9*b* resides within the first central flushing channel 5.

Figure 4A:
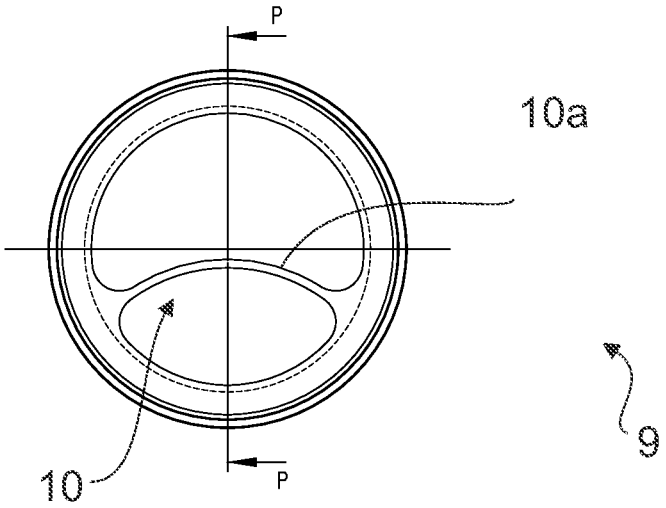
Figure 4B:
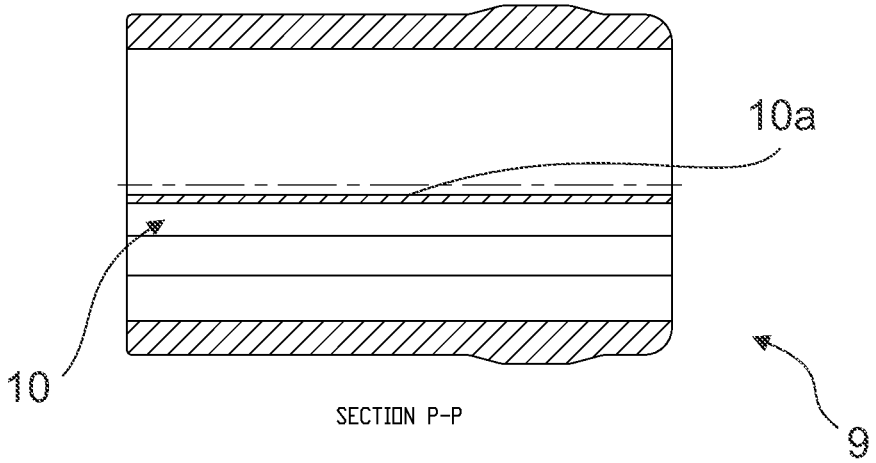
Figure 4C:
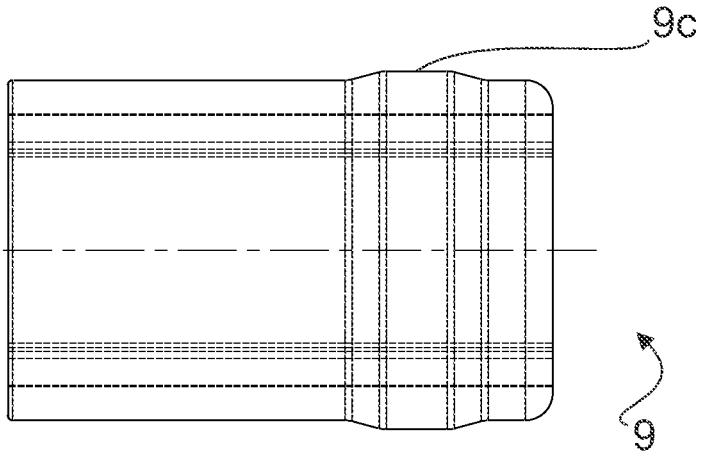

FIG. 4*a*-FIG. 4*c* illustrate an embodiment of the foot valve 9 according to the present disclosure as seen as plan view, longitudinally cut view and a side view, respectively. The embodiment of FIGS. 4*a*-4*c* is similar to that illustrated in FIG. 3*a*-FIG. 3*c* with the exception that the stiffener 10 is provided as curved internal wall 10*a* which does not run through the cross-sectional centre point of the foot valve 9, and extends along the whole length of the foot valve 9.

Figure 5A:
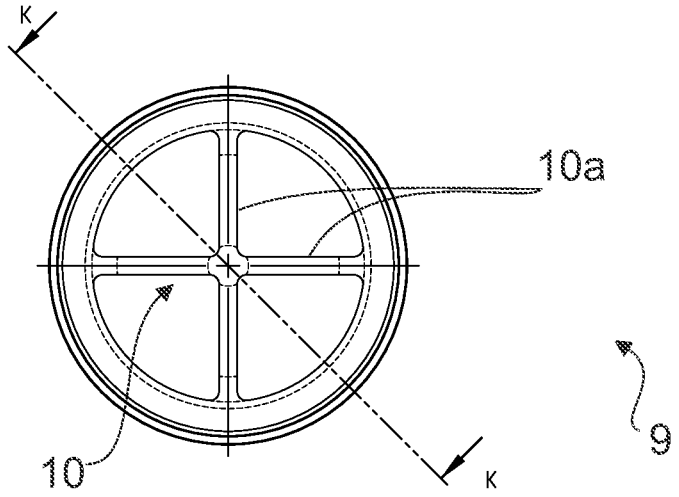
Figure 5B:
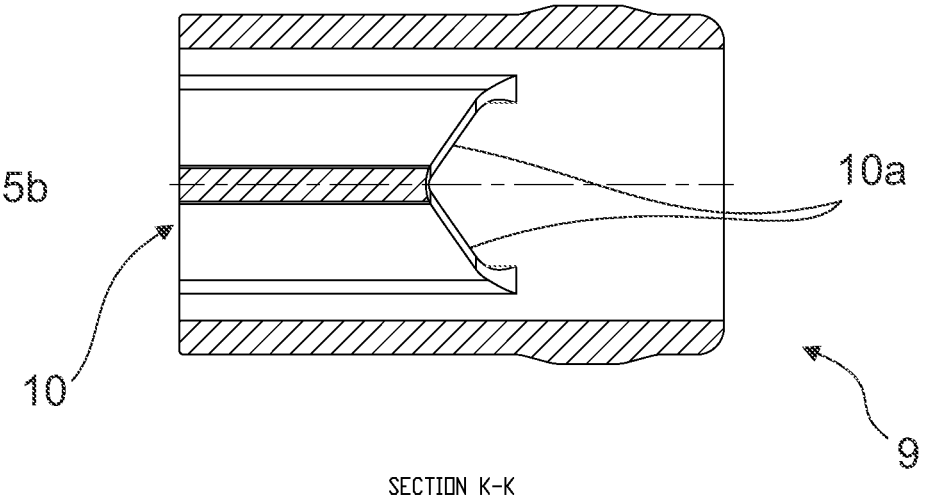
Figure 5C:
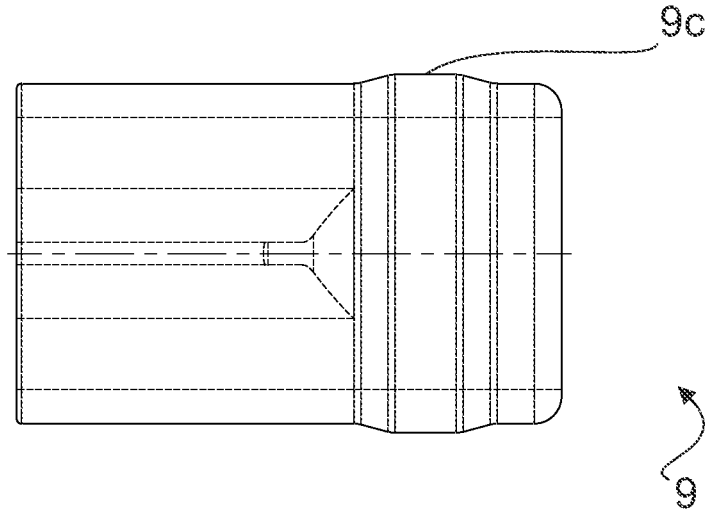

FIG. 5*a*-FIG. 5*c* illustrate an embodiment of the foot valve 9 according to the present disclosure as seen as plan view, longitudinally cut view and a side view, respectively. The embodiment of FIGS. 5*a*-5*c* is similar to that illustrated in FIG. 3*a*-FIG. 3*c* with the exception that the stiffener 10 is provided as two intersecting internal walls 10*a* forming a cross-like cross-sectional profile, in which the internal walls coincide at the cross-sectional centre point of the foot valve 9.

Figure 6A:
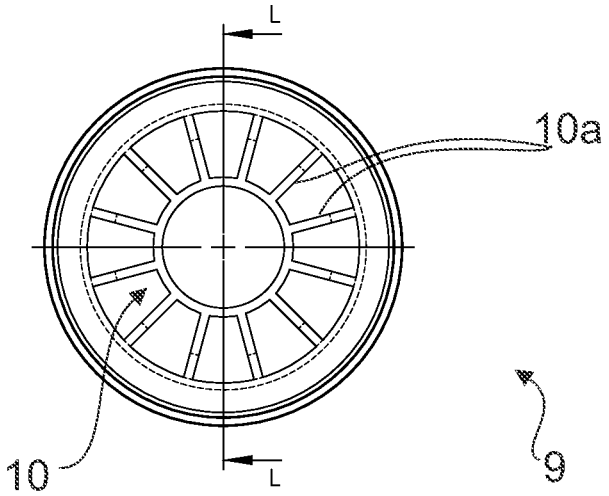
Figure 6B:
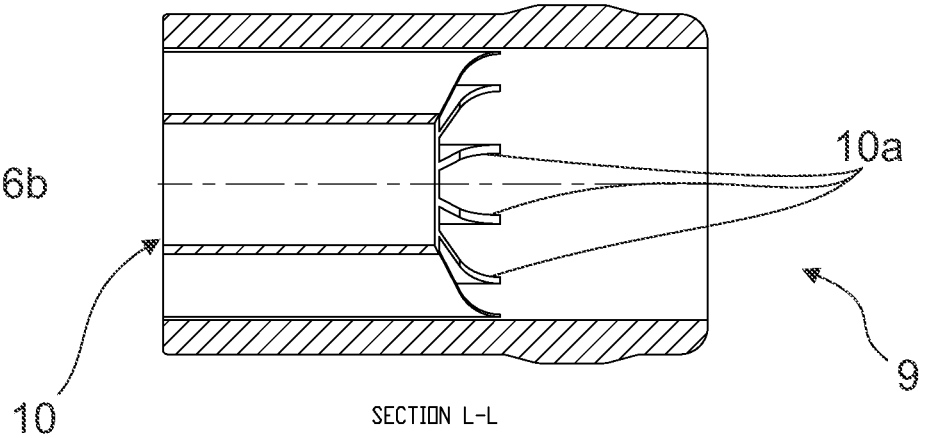
Figure 6C:
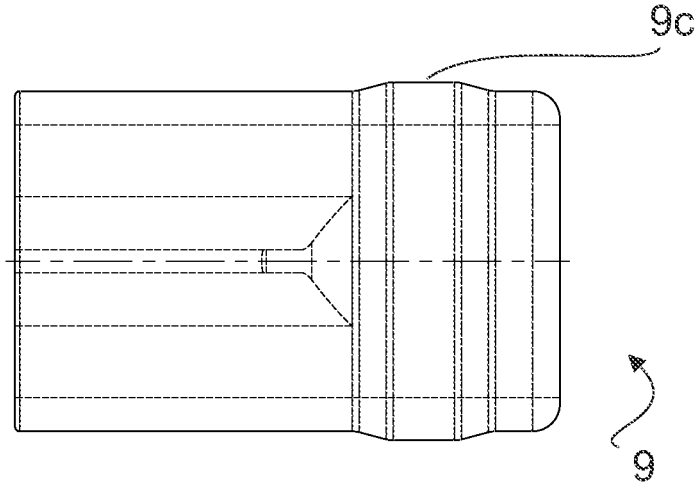

FIG. 6*a*-FIG. 6*c* illustrate an embodiment of the foot valve 9 according to the present disclosure as seen as plan view, longitudinally cut view and a side view, respectively. The embodiment of FIGS. 6*a*-6*c* is similar to that illustrated in FIG. 3*a*-FIG. 3*c* with the exception that the stiffener 10 is provided as a plurality of coinciding internal walls 10*a* forming a central tubular cross-sectional profile, from which radially extending spokes extend between the central tubular portion and the internal wall of the foot valve 9.

Figure 7A:
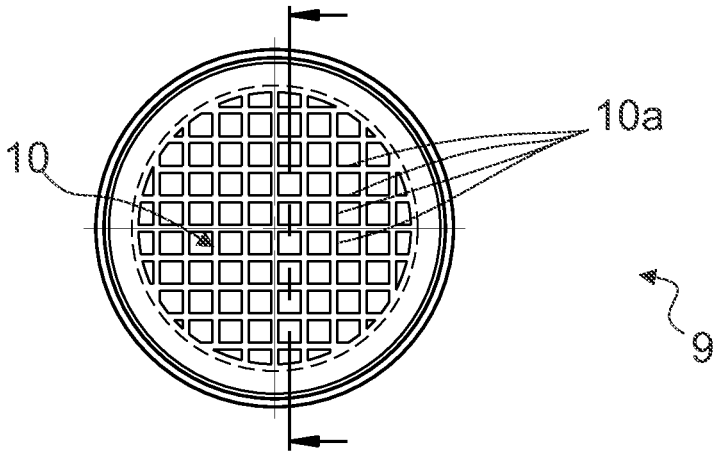
Figure 7B:
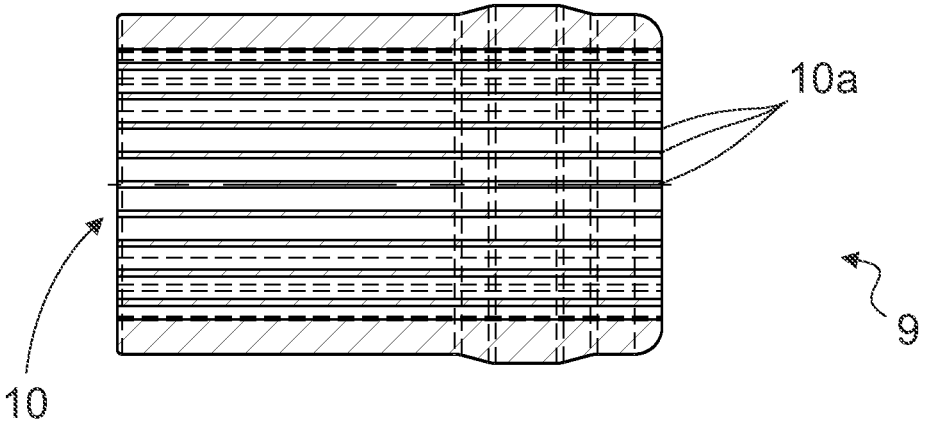
Figure 7C:
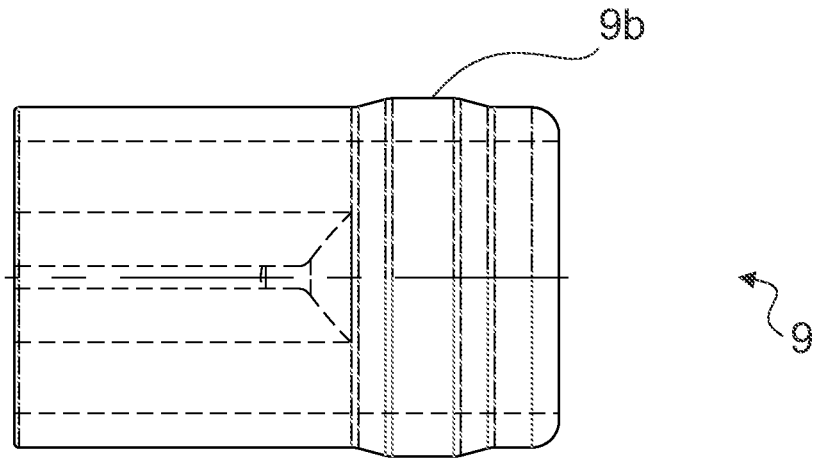

FIG. 7*a*-FIG. 7*c* illustrate an embodiment of the foot valve 9 according to the present disclosure as seen as plan view, longitudinally cut view and a side view, respectively. The embodiment of FIGS. 7*a*-7*c* is similar to that illustrated in FIG. 3*a*-FIG. 3*c* with the exception that the stiffener 10 is provided as a plurality of intersecting internal walls 10*a* forming cross-sectional rectangular grid-like pattern, in which rectangular cavities are formed between the internal walls 10*a*, and the stiffener 10 extends along the whole length of the foot valve 9.

Figure 8A:
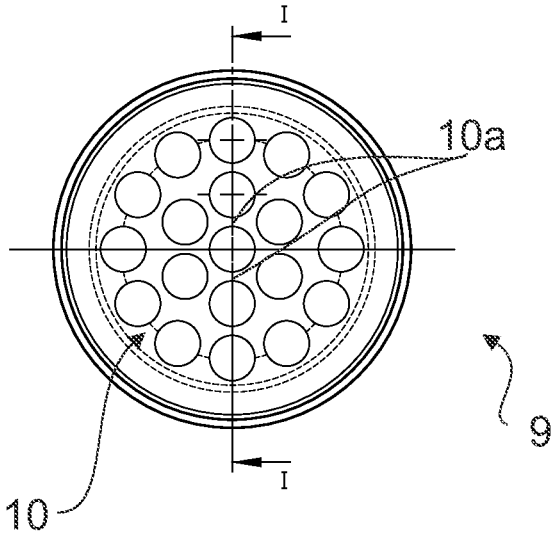
Figure 8B:
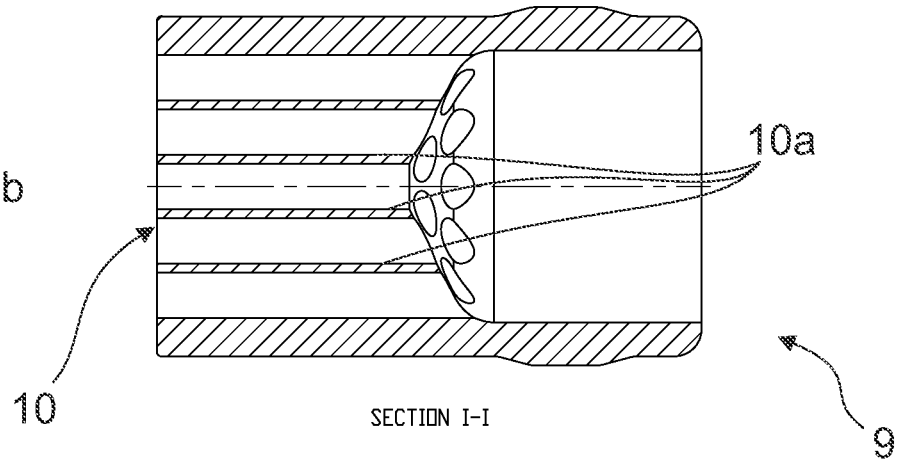
Figure 8C:
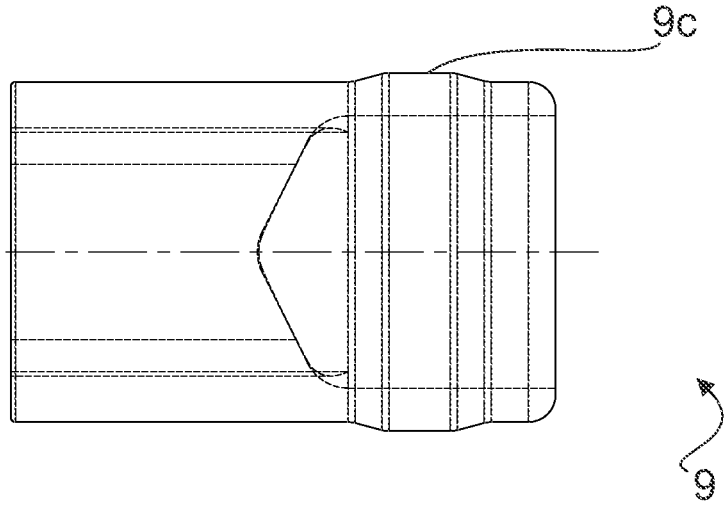

FIG. 8*a*-FIG. 8*c* illustrate an embodiment of the foot valve 9 according to the present disclosure as seen as plan view, longitudinally cut view and a side view, respectively. The embodiment of FIGS. 8*a*-8*c* is similar to that illustrated in FIG. 3*a*-FIG. 3*c* with the exception that the stiffener 10 is provided as a plurality of intersecting internal walls 10*a* forming cross-sectional tubular grid-like pattern, in which tubular cavities are formed between the internal walls 10*a*.

It should be noted that the appended drawings illustrate exemplary embodiments of the present disclosure, and that other, non-illustrated embodiments are also encompassed by the present disclosure. For example, the stiffener may alternatively be provided as internal splines, i.e. axially extending radial bulges, at which the material thickness of the foot valve is increased.

The invention claimed is:

1. A drill assembly for percussive drilling, the drill assembly comprising:

a drill bit extending along a longitudinal direction and including:

a distal portion having an end surface equipped with inserts configured for transferring percussive impact to points of contact with a borehole during operation;

a shank portion extending from the distal portion in an uphole direction, the shank portion being equipped with a male coupling configuration and, on a longitudinal uphole end of the shank portion, a first impact surface; and a first central flushing channel for conducting a flushing fluid flow to an end surface of the distal portion, said central flushing channel extending through at least the shank portion and being open towards the longitudinal uphole end of the shank portion, such that the first impact surface is formed annularly around the first central flushing channel;

a percussion device extending along a longitudinal direction and including:

on a downhole side end thereof, a female coupling configuration for coupling with the male coupling configuration of the drill bit; and an impact piston arranged within a housing and configured to reciprocate in the longitudinal direction, the impact piston having, on the downhole end of the piston, a central recess and a second impact surface annularly surrounding the central recess for impacting against the first impact surface of the drill bit as the impact piston is reciprocated; and a hollow cylindrical foot valve attached to the drill bit and partially received within the first central flushing channel and extending therefrom in an uphole direction, such that:

the foot valve is also partially received within the central recess, while the impact piston is in a lowermost position during reciprocation of the impact piston; and the foot valve is no longer received within the central recess, while the impact piston is in an uppermost position during reciprocation of the impact piston;

wherein the foot valve includes an internal stiffener extending radially inwardly from at least two circumferential positions of an inner surface of the foot valve; and wherein the internal stiffener is formed as an integral part of the foot valve, as one or more internal walls of the foot valve.

2. The drill assembly according to claim 1, wherein the internal stiffener extends along a longitudinal length of the foot valve.

3. The drill assembly according to claim 2, wherein the internal stiffener is formed as a plurality of internal walls of the foot valve such that at least two of the internal walls coincide with each other, as seen along a cross-sectional profile of the foot valve perpendicular to a longitudinal direction thereof.

4. The drill assembly according to claim 2, wherein the internal stiffener is formed as a plurality of internal walls of the foot valve such that at least two of the internal walls intersect with each other, as seen along a cross-sectional profile of the foot valve perpendicular to a longitudinal direction thereof.

5. The drill assembly according to claim 2, wherein the internal stiffener extends longitudinally for a first distance from an uphole side end of the foot valve, the first distance being more than or equal to a distance for which the foot valve projects from the drill bit.

6. The drill assembly according to claim 2, wherein the internal stiffener extends longitudinally for a first distance from an uphole side end of the foot valve, the first distance being less than or equal to a distance for which the foot valve projects from the drill bit.

7. The drill assembly according to claim 2, comprising:

a cut-out extending radially through foot valve, extending axially for a second distance from a downhole side end of the foot valve, wherein the second distance is less than or equal to a length at which the foot valve is received within the drill bit.

8. The drill assembly according to claim 7, wherein a projection of the cut-out on a plane parallel with the longitudinal direction is a differentiable curvature opening towards a downhole side end of the foot valve.

9. The drill assembly according to claim 2, wherein the foot valve is provided with a section of increased outer diameter at a portion of the foot valve received within the drill bit.

10. The drill assembly according to claim 1, wherein the internal stiffener is formed as a plurality of internal walls of the foot valve such that at least two of the internal walls coincide with each other, as seen along a cross-sectional profile of the foot valve perpendicular to a longitudinal direction thereof.

11. The drill assembly according to claim 1, wherein the internal stiffener is formed as a plurality of internal walls of the foot valve such that at least two of the internal walls intersect with each other, as seen along a cross-sectional profile of the foot valve perpendicular to a longitudinal direction thereof.

12. The drill assembly according to claim 1, wherein the internal stiffener extends longitudinally for a first distance from an uphole side end of the foot valve, the first distance being more than or equal to a distance for which the foot valve projects from the drill bit.

13. The drill assembly according to claim 1, wherein the internal stiffener extends longitudinally for a first distance from an uphole side end of the foot valve, the first distance being less than or equal to a distance for which the foot valve projects from the drill bit.

14. The drill assembly according to claim 1, comprising:

a cut-out extending radially through foot valve, extending axially for a second distance from a downhole side end of the foot valve, wherein the second distance is less than or equal to a length at which the foot valve is received within the drill bit.

15. The drill assembly according to claim 14, wherein a projection of the cut-out on a plane parallel with the longitudinal direction is a differentiable curvature opening towards a downhole side end of the foot valve.

16. The drill assembly according to claim 1, wherein the foot valve is provided with a section of increased outer diameter at a portion of the foot valve received within the drill bit.

* * * * *